US008113508B2

(12) United States Patent
Onodera et al.

(10) Patent No.: US 8,113,508 B2
(45) Date of Patent: Feb. 14, 2012

(54) BILL PROCESSOR

(75) Inventors: Yasuhiro Onodera, Tsukuba (JP); Toru Inage, Kasukabe (JP); Tomohisa Oe, Saitama (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 614 days.

(21) Appl. No.: 11/798,832

(22) Filed: May 17, 2007

(65) Prior Publication Data

US 2007/0278736 A1 Dec. 6, 2007

(30) Foreign Application Priority Data

May 30, 2006 (JP) ..... P2006-149517

(51) Int. Cl.
*B65H 31/00* (2006.01)

(52) U.S. Cl. ..... 271/209; 271/188; 271/207; 271/314

(58) Field of Classification Search ..... 271/209, 271/188, 178, 177, 220, 224, 223, 314
See application file for complete search history.

(56) References Cited

U.S. PATENT DOCUMENTS

| | | | | |
|---|---|---|---|---|
| 1,750,396 | A * | 3/1930 | Evans et al. | 271/188 |
| 4,273,325 | A * | 6/1981 | Rodewald | 271/220 |
| 4,664,368 | A * | 5/1987 | Bouwens et al. | 271/209 |
| 5,123,807 | A * | 6/1992 | Nakaoda et al. | 414/789.6 |
| 5,590,871 | A * | 1/1997 | Okabe et al. | 270/58.27 |
| 5,769,412 | A * | 6/1998 | Takemoto et al. | 271/188 |
| 5,903,812 | A * | 5/1999 | Kondoh et al. | 399/373 |
| 6,032,948 | A * | 3/2000 | Peebles et al. | 271/224 |
| 6,394,448 | B2 * | 5/2002 | Suzuki et al. | 271/189 |
| 6,536,761 | B2 * | 3/2003 | Mochizuki et al. | 271/208 |
| 6,991,229 | B2 * | 1/2006 | Yamakawa et al. | 271/223 |
| 7,641,195 | B2 * | 1/2010 | Suzuki | 271/307 |
| 2006/0012101 | A1 | 1/2006 | Katou et al. | |

FOREIGN PATENT DOCUMENTS

| | | |
|---|---|---|
| CN | 1508056 A | 6/2004 |
| CN | 1605553 A | 4/2005 |
| EP | 0 532 217 A1 | 9/1992 |
| EP | 0793199 A2 | 9/1997 |

(Continued)

OTHER PUBLICATIONS

Office Action for corresponding Chinese Application No. 200710106380.7, issued Dec. 4, 2009, with English Translation, 7 pages.

(Continued)

*Primary Examiner* — Michael McCullough
*Assistant Examiner* — Luis A Gonzalez
(74) *Attorney, Agent, or Firm* — Nixon & Vanderhye P.C.

(57) ABSTRACT

The invention provides a bill processor that substantially horizontally delivers bills one by one to an upper space of a stacking unit from a delivery unit, downward strikes and drops the trailing edge of a delivered bill in its delivery direction by impellers, and stacks the bills in the stacking unit. The bill handling machine has a regulating member that engages the leading edge of the bill in its delivery direction, which is delivered to the upper space of the stacking unit from the delivery unit. The regulating member can be changed in position in the delivery direction according to the length of a bill in the delivery direction.

16 Claims, 4 Drawing Sheets

FOREIGN PATENT DOCUMENTS

| | | | | |
|---|---|---|---|---|
| EP | 1 167 260 | A2 | | 1/2002 |
| JP | 56-121051 | | | 9/1981 |
| JP | 59-064470 | | | 4/1984 |
| JP | H62-197656 | | | 12/1987 |
| JP | 63267625 | A | * | 11/1988 |
| JP | H2-49957 | | | 4/1990 |
| JP | 02310250 | A | * | 12/1990 |
| JP | 04-350060 | | | 12/1992 |
| JP | 06-183621 | | | 7/1994 |
| JP | 2000-048234 | | | 2/2000 |
| JP | 2004-107079 | | | 4/2004 |
| TW | 326513 | | | 2/1998 |

OTHER PUBLICATIONS

European Search Report in EP 07 10 8941 dated Aug. 3, 2010.
Office Action issued Apr. 8, 2010 in Taiwan Patent Application No. 096118905 and English translation, 5 pages.
Taiwan Search Report completed Mar. 26, 2010 and English translation, 2 pages.
Japanese Notice of Reasons for Rejection and English Translation for corresponding Japanese Application No. 2006-149517, mailed Aug. 30, 2011, 4 pages.
Japanese Decision of Rejection and English Translation for corresponding Japanese Appln. No. 2006-149517, mailed Nov. 22, 2011, 3 pages.

* cited by examiner

BILL PROCESSOR

BACKGROUND OF THE INVENTION

1. Field of the Invention

The present invention relates to a bill processor, and particularly, to a bill processor capable of favorably aligning and stacking bills the lengths of which in the delivery direction are different from one another.

Priority is claimed on Japanese Patent Application No. 2006-149517 filed May 30, 2006, the content of which is incorporated herein by reference.

2. Description of the Related Art

A bill processor which delivers bills (Euro bills, etc.) the longitudinal length of which are different from one another in their longitudinal direction, and aligns and stacks the bills in the same stacking unit with their leading edges arranged is disclosed in Japanese Unexamined Patent Application, First Publication, No. H06-183621.

In this bill processor, a bill is conveyed to an upper space of a stacking unit, and the trailing edge of the bill is struck and dropped into a stacking unit by an impeller (striking and dropping unit). This impeller is installed so as to be movable in the delivery direction of bills, and moves according to the length (length in the delivery direction) of a bill delivered into the upper space.

However, since the conventional bill processor needs a mechanism which moves the impeller in the delivery direction of bills and rotationally drives the impeller, its structure is complicated.

Also, if the impeller is made to move in the delivery direction of bills while the impeller strikes and drops the bills, it is not possible to align and stack the bills. That is, in the case where the impeller is made to move upstream in the delivery direction when bills are struck and dropped, a bill in the course of being struck and dropped may be caused to move upstream. At this time, in a case where the impeller is made to move downstream in the delivery direction, a bill in the course of being struck and dropped may be caused to move downstream. As a result, there is a possibility that bills cannot be aligned and stacked in the stacking unit, and consequently, poor stacking may be caused. Particularly if a preceding bill is moved downstream in the stacking unit, the bill may be stuffed into the stacking unit and curl up. A succeeding bill collides against the preceding bill, and consequently, alignment of bills becomes much more difficult.

Therefore, movement of the impeller in the delivery direction of bills needs to be performed while the impeller is surely separated from the trailing edge of a bill. For this reason, it is difficult to stop rotational driving of the impeller during movement of the impeller, and to increase the conveyance speed of bills or shorten the conveyance interval of bills. That is, increasing the throughput per unit time of bills is hindered.

SUMMARY OF THE INVENTION

The object of the invention is to provide a bill processor capable of favorably aligning and stacking bills the lengths of which in the delivery direction are different from one another in the same stacking unit.

In order to attain the above object, a bill processor according to the present invention includes a delivery unit that substantially horizontally delivers bills one by one to an upper space of a stacking unit where bills are to be stacked; a striking and dropping unit that strikes and drops the trailing edge of a delivered bill in its delivery direction; a regulating member that engages the bill delivered to the upper space of the stacking unit at the leading edge of the bill in its delivery direction; and a position changing mechanism that changes the position of the regulating member in the delivery direction according to the length of the bill in the delivery direction.

In the bill processor of the present invention, the regulating member may be provided in a state of always projecting downward from a top wall that forms an upper edge of the upper space of the stacking unit, and the regulating member may be supported so as to be movable in the delivery direction of the bill along the upper wall.

In the bill processor of the present invention, the position changing mechanism may have a belt that is wound between a pair of pulleys driven by a motor to support the regulating member, and the bill processor may include a position detector that detects the position of the regulating member.

In the bill processor of the present invention, the regulating member may be supported from the top wall that forms the upper edge of the upper space of the stacking unit so as to be protruded into or retracted from the upper space.

In the bill processor of the present invention, the position changing mechanism may include an arm that hold the regulating member and is rockable about a pivot, and the arm is rocked about the pivot by a driving mechanism.

In the bill processor of the present invention, a plurality of the regulating member may be provided.

In the bill processor of the present invention, the top wall may be formed in a substantially horizontal posture or in an upwardly inclined posture that ascends towards the front side in the delivery direction of the bill, and the bill may be delivered along the upper wall from the delivery unit.

In the bill processor of the present invention, the delivery unit may include a waveform forming part that makes the bill into a waveform in a direction orthogonal to the delivery direction.

According to the present invention, the regulating member is provided at a position where the delivery direction can be changed according to the length of a bill, so that the trailing edge of the bill can be struck and dropped in the stacking unit by the striking and dropping unit in a state where the leading edge of the bill delivered from the delivery unit is made to engage the regulating member. Accordingly, bills having different lengths in the delivery direction can be aligned and stacked with their trailing edges arranged. Since it is not necessary to move the striking and dropping unit in the delivery direction, the structure of the bill handling machine is simplified, and the striking and dropping unit does not move bills to the upstream or downstream in the delivery direction. Therefore, bills can be favorably stacked in the stacking unit. Moreover, although a succeeding bill is fed into the upper space of the stacking unit while the trailing edge of the preceding bill is struck and dropped by the striking and dropping unit, stacking of the preceding bill can be performed normally. Accordingly, even if the conveyance interval of bills is shortened, aligning and stacking of the bills can be performed favorably.

DESCRIPTION OF THE PREFERRED EMBODIMENTS

Figure 1:
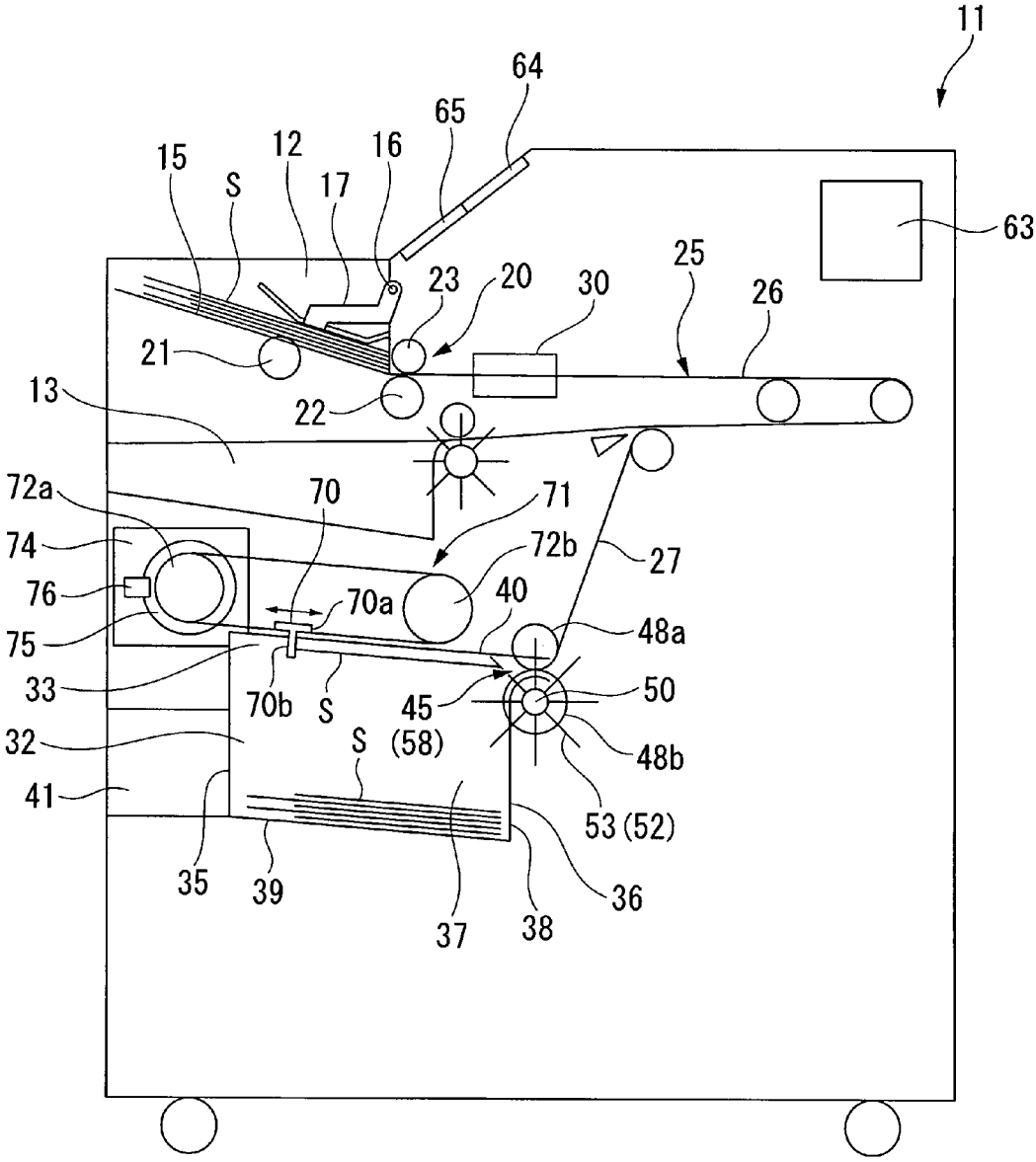
FIG. 1 is a side sectional view schematically showing a bill processor according to a first embodiment of the invention.

A bill processor of a first embodiment of the invention will be described below with reference to FIGS. 1 to 4. In the bill processor 11 of the first embodiment, as shown in FIG. 1, a charging unit 12 into which loose bills S are inserted is provided in a front upper part of a processor body. A rejection unit 13 to which a rejected bill S is fed from the inside of the processor body is provided below the charging unit 12.

The charging unit 12 has a stand 15 which is inclined slightly backward with respect to a horizontal plane to form a bottom. Bills S are loaded on the stand 15 in a state where they are stacked in an up-and-down direction with the longitudinal direction thereof set in a forward and backward direction. In addition, the stand 15 may be disposed horizontally.

The charging unit 12 is provided with a rotary shaft 16 disposed in the right-and-left direction of the processor body above the stand 15 on the deep side of the processor body, and a bill press 17 which is rotatably supported by the rotary shaft 16 so as to be rockable up and down above the stand 15, and nips the bills S loaded on the stand 15 between itself and the stand S.

A separating/feeding unit 20, which separates the loose bills S loaded on the stand 15 in this way one by one from the lowermost bill and feeds the separated bill into the processor body, is provided on the side of the processor body deeper than the charging unit 12. The separating/feeding unit 20 has an ejection roller 21, a feed roller 22, and a separation roller 23. The ejection roller 21 is rotatably provided in the stand 15 of the charging unit 12 so as to be rotatable about an axis running in the right-and-left direction of the processor body in a state in which its upper part is made to partially project from the stand 15. The feed roller 22 is rotatably provided about an axis parallel to the ejection roller 21 on the side of the processor body deeper than the stand 15. The separation roller 23 is rotatably provided about an axis parallel to the ejection roller 22 above the feed roller 22. By means of a one-way clutch (not shown), the rotation of the separation roller 23 is regulated in a direction in which the feed roller 22 moves towards the deep side of the processor body and only the rotation of the separation roller in the direction opposite to the above direction is allowed.

Such a separating/feeding unit 20 ejects the lowermost loose bill S loaded on the stand 15 between the feed roller 22 and the separation roller 23 by the ejection roller 21. A bill S that is dragged by the lowermost bill S and moved between the feed roller 22 and the separation roller 23 by this ejection is stopped by the separation roller 23, and only the lowermost bill S ejected towards the processor body is fed by the feed roller 22.

A conveying unit 25 which conveys the bill S fed from the separating/feeding unit 20 is connected to the separating/feeding unit 20 on the deep side of the processor body. The conveying unit 25 is constituted by a plurality of guide plates which guide bills S, conveyance rollers, distribution members, etc. The conveying unit 25 has a conveying path 26 which extends substantially horizontally from the separating/feeding unit 20, is then folded back downward, then extends substantially horizontally towards the near side of the processor body, and is then connected to the rejection unit 13, and a conveying path 27 which extends down-forward from the middle of the conveying path 26. The conveying path 26 is provided with a discrimination unit 30 which determines denomination, authenticity, normal/damaged state, and conveyance abnormality of bills S and counts the bills, during conveyance thereof.

A stacking unit 32 on which bills S that are determined to be authentic bills, normal bills, and normal conveyance by the discrimination unit 30 are stacked by denomination mixing is connected to a terminal position of the conveying path 27 of the conveying unit 25.

Bills S are loaded into the charging unit 12 in a posture in which the longitudinal direction of the bills is set in a separating/feeding direction of the separating/feeding unit 20. The conveying unit 25 conveys bills S in a posture in which their longitudinal direction is set in a conveying direction, and delivers them to either the stacking unit 32 or the rejection unit 13 in a posture in which their longitudinal direction is set in the delivery direction.

The stacking unit 32 has an angled cylindrical wall structure 38 having a front wall 35 vertically erected in front of the delivery direction of the conveying path 27, a rear wall 36 vertically erected behind the delivery direction of the conveying path 27, and a pair of side walls 37 which connect the same right and left sides of the front wall 35 and the rear wall 36 together and are vertically erected. The stacking unit 32 further has a bottom wall 39 which closes a bottom opening of the angled cylindrical wall structure 38, and a top wall 40 which closes a top opening of the angled cylindrical wall structure 38. The bottom wall 39 and the top wall 40 are installed in such an upwardly inclined posture that they rises slightly with respect to the horizontal plane from the deep side of the processor body towards the front side of the processor body (in other words, towards the front of the delivery direction of bills S delivered from the delivery unit 45). However, the bottom wall 39 and the top wall 40 are disposed in a substantially horizontal posture. A portion of the front wall 35 is constituted by a rear face of an openable/closable return door 41 of the front face of the processor body.

Also, a portion along the top wall 40 in an internal space of the stacking unit 32 surrounded by the wall structure 38, the bottom wall 39, and the top wall 40 is referred to as an upper space 33 of the stacking unit 32. The top wall 40 forms an upper edge of the upper space 33.

Figure 2:
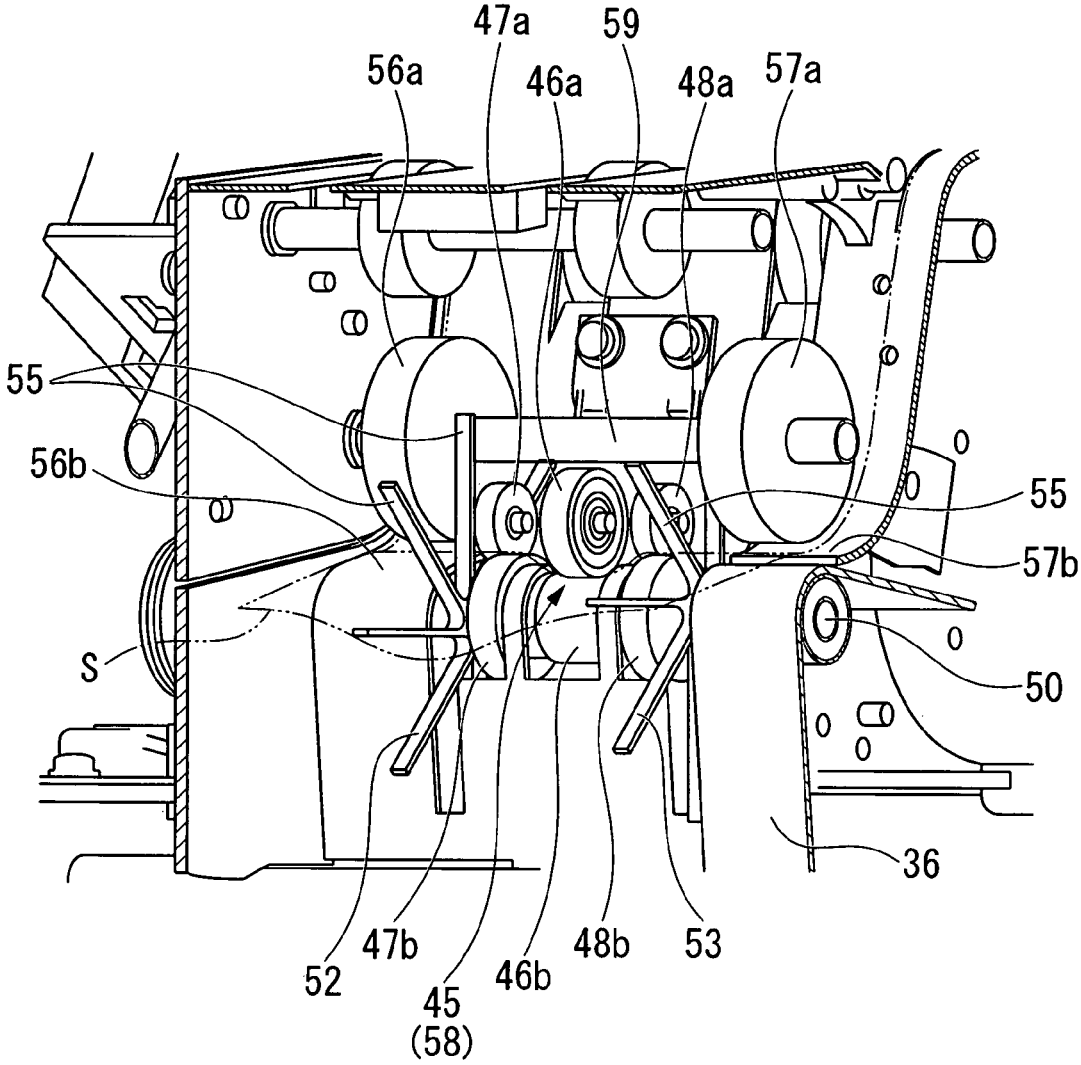
FIG. 2 is a perspective view showing a delivery unit of the bill processor of the first embodiment of the invention.
Figure 3:
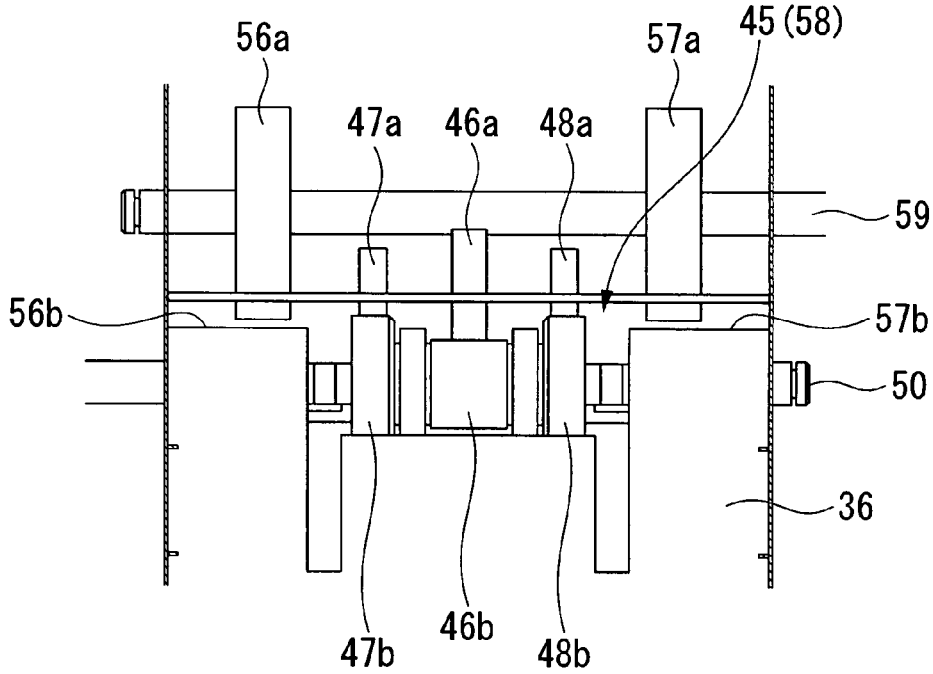
FIG. 3 is a front view showing the delivery unit of the bill processor of the first embodiment of the invention.

The delivery unit 45 is provided in a portion that is connected to the stacking unit 32 in a terminal position of the conveying path 27 of the conveying unit 25. As shown in FIGS. 2 and 3, the delivery unit 45 includes a pair of rotatable intermediate rollers 46*a* and 46*b* parallel to the feed roller 22. The intermediate rollers 46*a* and 46*b* nip almost a middle portion of a bill S in its lateral direction orthogonal to the delivery direction thereof from both the upper and lower sides (both the front and back sides of the bill). The delivery unit 45 further includes two pairs of outer rollers 47*a* and 47*b* and outer rollers 48*a* and 48*b* which are respectively provided so as to be separated at an equal distance on both sides of the intermediate rollers 46*a* and 46*b* in the lateral direction of bills S. The outer rollers 47*a* and 47*b* and the outer rollers 48*a* and 48*b* nip a bill S from both the upper and lower sides (both the front and back sides) in a bill nipping position which is offset upward from the bill nipping position of the pair of intermediate rollers 46*a* and 46*b*. That is, the bill nipping position of the intermediate rollers 46*a* and 46*b*, the bill nipping position of the outer rollers 47*a* and 47*b*, and the bill nipping position of the outer rollers 48*a* and 48*b* are disposed in the shape of the letter "V" as seen from the front side in the delivery direction of bills.

The lower intermediate roller 46*b*, the lower outer roller 47*b*, and the lower outer roller 48*b* are supported by a common driving shaft 50 disposed on the upper outside of the rear wall 36, and all of them are disposed on the same axis. The upper intermediate roller 46*a*, the upper outer roller 47*a*, and the upper outer roller 48*a* are disposed on the same axis. The upper intermediate roller 46*a* has a larger diameter than the lower intermediate roller 46*b*. Meanwhile, both the lower outer rollers 47*b* and 48*b* have the same diameter, and both the upper outer rollers 47*a* and 48*a* have the same diameter. The outer rollers 47*a* and 48*a* also have a smaller diameter than the outer rollers 47*b* and 48*b*. Accordingly, the bill nipping position is formed in the shape of the letter "V" as described above.

The delivery unit 45, as shown in FIG. 2 (illustration is omitted in FIG. 3), has impellers (striking and dropping unit) 52 and 53, respectively, on both outsides of the outer rollers 47*a* and 47*b* and the outer rollers 48*a* and 48*b* in the lateral direction of bills S. These impellers 52 and 53 are supported by the driving shaft 50 further outside than both the outer rollers 47*b* and 48*b*. A plurality of blades 55 are radially formed in each of the impellers 52 and 53. These impellers 52 and 53 are dimensioned such that the blades 55 are made to project from the rear wall 36 towards the front wall 35 and the blades 55 do not contact the bottom wall 39 during rotation. The rear wall 36 and the top wall 40 are cut out such that they do not interfere with the blades 55 during rotation.

Moreover, a conveyance roller (guide means) 56*a* and a guide (guide means) 56*b*, and a conveyance roller (guide means) 57*a* and a guide (guide means) 57*b* are disposed further outside than both the impellers 52 and 53, respectively, on both outsides of the outer rollers 47*a* and 47*b* and the outer rollers 48*a* and 48*b* in the lateral direction of bills S in the delivery unit 45. The conveyance roller 56*a* and the guide 56*b*, and the conveyance roller 57*a* and the guide 57*b* guide a bill S on both the front and back sides thereof in a bill guiding position that is offset to the downside that is nearer to the bill nipping position of the intermediate rollers 46*a* and 46*b* than the bill nipping positions of two pairs of outer rollers 47*a* and 47*b* and outer rollers 48*a* and 48*b*.

Both the conveyance rollers 56*a* and 57*a* are supported by a common driving shaft 59 disposed above the intermediate roller 46*a* and outer rollers 47*a* and 48*a*. Both the guides 56*b* and 57*b* are bent in the shape of a substantially circular arc so as to extend along the outer peripheral surfaces of the conveyance rollers 56*a* and 57*a* with a predetermined clearance therefrom, and moreover, and the ends of the guides on the side of the stacking unit 32 are adapted to have the same angle of inclination as the top wall 40. Both the guides 56*b* and 57*b* are disposed above the aforementioned driving shaft 50.

In the delivery unit 45, both the conveyance rollers 56*a* and 57*a* are fixed to the driving shaft 59, and the conveyance rollers are rotated by rotation of the driving shaft 59 by a motor (illustration thereof is omitted) such that their guides 56*b* and 57*b* are moved towards the stacking unit 32. The lower intermediate roller 46*b*, the outer rollers 47*b* and 48*b*, and the impellers 52 and 53 are fixed to the driving shaft 52, and they are rotated by rotation of the driving shaft 50 by a motor (illustration thereof is omitted) such that their respective upper sides are moved towards the stacking unit 32. In contrast, the upper intermediate roller 46*a* and the upper outer rollers 47*a* and 48*a* are freely rotatable, respectively, and they rotates so as to follow the rotation of the lower intermediate roller 46*b* and the lower outer rollers 47*b* and 48*b*.

As shown in FIG. 1, a regulating member 70 which can engage a leading edge (hereinafter referred to as "the leading edge of a bill"), in the delivery direction (hereinafter referred to as "the bill delivery direction"), of a bill S delivered to the upper space 33 from the delivery unit 45 is disposed in the upper space 33 of the stacking unit 32. The regulating member 70 is disposed in a position where a leading edge having a substantially middle predetermined width in the lateral direction of bills S delivered from the delivery unit 45 abuts. The regulating member 70 is supported so as to be movable in the bill delivery direction by the regulating member moving device (position changing mechanism) 71 which is disposed above the top wall 40 of the stacking unit 32 and is supported by the processor body.

The regulating member moving device 71 has a driving pulley 72*a* and a driven pulley 72*b* which are disposed in parallel with the conveyance rollers 56*a* and 57*a* of the delivery unit 45, a belt 73 which is wound between the pulleys 72*a* and 72*b*, and a motor 74 which rotates the driving pulley 72*a*. The driving pulley 72*a* is provided with a position detecting plate 75 which is fixed coaxially to rotate synchronously, and a rotational angle sensor 76 which detects the rotational angle of the position detecting plate 75.

The motor 74 and the driving pulley 72*a* are disposed nearer to a front upper portion of the processor body than the front wall 35 of the stacking unit 32, and the driven pulley 72*b* is disposed nearer to the rear wall 36 above the top wall 40. A portion of the belt 73 wound around both the pulley 72*a* and 72*b* travels parallel to the top wall 40 with a predetermined clearance therefrom. The regulating member 70 is attached to the belt 73 traveling along the top wall 40.

The regulating member 70 has a T-shaped cross section, and its stopper 70*b* which engages the leading edge of a bill S extends perpendicularly downward from a middle portion of a supporting part 70*a* fixed to the belt 73. The stopper 70*b* passes through an opening (illustration thereof is omitted) formed in the top wall 40 in the bill delivery direction, and projects into the upper space 33. The regulating member 70 can be moved in the bill delivery direction by rotationally driving the driving pulley 72*a* by way of the motor 74, thereby causing the belt 73 to travel. The rotational angle sensor 76 detects the rotational angle of the position detecting plate 75 from a predetermined reference position (initial position), and detects the position of the regulating member 70 on the basis of the detected result. That is, the position detecting plate 75 and the rotational angle sensor 76 constitute a position detector which detects the position of the regulating member 70.

The stopper 70*b* of the regulating member 70 regulates the leading edge position of a bill S delivered to the upper space 33 of the stacking unit 32 from the delivery unit 45. Accordingly, in the case where bills S, the longitudinal dimensions of which (lengths in the delivery direction) are different from one another, are conveyed to the upper space, the trailing edges of all the bills S in the bill delivery direction can be aligned along the rear wall 36.

As shown in FIG. 1, the bill processor 11 is provided with a control unit 63 that controls the aforementioned separating/feeding unit 20, conveying unit 25, discrimination unit 30, and motor 74, a display unit 64 which performs display for an operator, and an operation unit 65 which allows an operator to enter operational input. Electrical signals according to the detection angle of the rotational angle sensor 76 are input to the control unit 63.

A case where stack processing of bills S, the longitudinal dimensions of which are different from one another, is performed in the bill processor 11 constituted in this way will be described. An operator lifts the bill press 17 of the charging unit 12, and then loads bills S in a state where their longitudinal direction is set in the forward and backward direction of the processor body, and their longitudinal leading edges are arranged. Although both charging of mixed denominations and charging of a single denomination are allowed at this time, a case where two kinds of bills S, the longitudinal dimensions of which are different from each other, are mixed together and loaded will be described.

If an operator inputs a request to start processing in the operation unit 65, the control unit 63 drives the separating/feeding unit 20 and the conveying unit 25. Then, the bills S loaded into the charging unit 12 are fed into the processor body one by one from the lowermost bill S, and the fed bills S are conveyed by the conveying unit 25. During conveyance of bills, determination of denomination, authenticity, normal/damaged state, and the like and counting of the bills are performed by the discrimination unit 30. Bills S determined as acceptable are delivered to the conveying path 27, and the other bills S are delivered to the rejection unit 13. In addition, the bills S delivered to the rejection unit 13 can be taken out of the machine.

Figure 4:
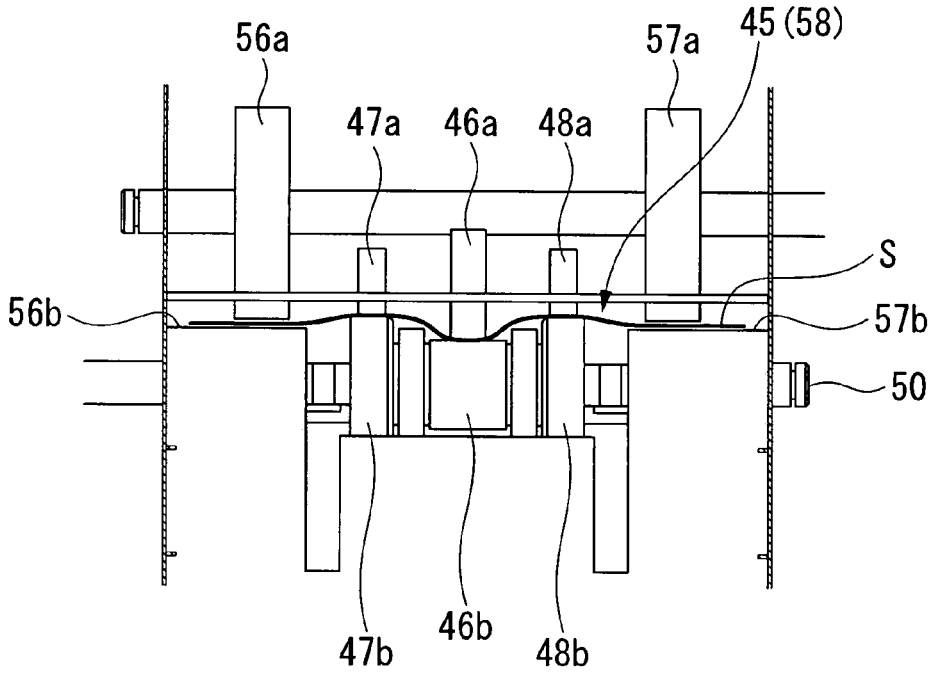
FIG. 4 is a front view showing the delivery unit of the bill processor of the first embodiment of the invention.

The bills S determined as acceptable are conveyed towards the stacking unit 32 by the conveyance rollers 56*a* and 57*a* and the guides 56*b* and 57*b* in the delivery unit 45 at a terminal end of the conveying path 27. As shown in FIGS. 2 and 4, the bills S conveyed by the conveyance rollers 56*a* and 57*a* and the guides 56*b* and 57*b* are further delivered to the upper space 33 of the stacking unit 32 obliquely upward along the top wall 40 by the intermediate rollers 46*a* and 46*b* and the outer rollers 47*a*, 47*b*, 48*a*, and 48*b*.

During this delivery, the bills S are conveyed in their longitudinal direction while their lateral portions are guided between the intermediate roller 46*a* and 46*b*, between the outer roller 48*a* and 48*b*, between the outer rollers 47*a* and 47*b*, between the conveyance roller 56*a* and the guide 56*b* and between the conveyance roller 57*a* and the guide 57*b*. That is, a lateral intermediate position of a bill S is nipped by the intermediate rollers 46*a* and 46*b*, one outer position of the bill outside the lateral intermediate position is nipped by the outer rollers 47*a* and 47*b*, the other outer position of the bill outside the lateral intermediate position is nipped by the outer rollers 48*a* and 48*b*, one outer position of the bill further outside the one lateral outer position is guided by the conveyance roller 56*a* and the guide 56*b*, and another outer position of the bill further outside the other lateral outer position is guided and conveyed by the conveyance roller 57*a* and the guide 57*b*. After the bill S continuously passes through the above rollers and guides over its entire longitudinal length, it is delivered along the top wall 40 of the upper space 33 of the stacking unit 32.

The bill nipping position of the outer rollers 47*a* and 47*b* and the bill nipping position of the outer rollers 48*a* and 48*b* are offset upward from the bill nipping position of the intermediate rollers 46*a* and 46*b* of the delivery unit 45. Accordingly, a bill S is bent substantially in the shape of the letter "V" in the lateral direction thereof. Moreover, the guiding position between the conveyance roller 56*a* and 56*b* and the guiding position between the conveyance roller 57*a* and the guide 57*b* are offset downward from the bill nipping position of the outer rollers 47*a* and 47*b* and the bill nipping position of the outer rollers 48*a* and 48*b*. Accordingly, a bill S is conveyed while it is bent substantially in the shape of the letter "W" in the lateral direction thereof. The bill S is delivered to the stacking unit 32 after such gentle wavelike bending is continuously performed on the bill over its entire longitudinal length. As such, the intermediate rollers 46*a* and 46*b*, the outer rollers 47*a* and 47*b*, the outer rollers 48*a* and 48*b*, the conveyance roller 56*a* and the guide 56*b*, and the conveyance roller 57*a* and the guide 57*b* constitute a waveform forming means 58 which makes a bill S into a waveform in a direction orthogonal to its delivery direction to form a waveform.

Thereby, even if bills S with creases, curls, wrinkles, etc. are loaded into the charging unit 12, the bills S can be delivered to the upper space 33 of the stacking unit 32 after being corrected, and the rigidity of the bills S can be increased to enhance straight advancement. As a result, bills S advance straight along the top wall 40 in the upper space 33 even while they are delivered from the delivery unit 45 or even immediately after they are delivered from the delivery unit 45.

The denomination of bills S determined in the discrimination unit 30 and the signals from the rotational angle sensor 76 are input to the control unit 63 immediately before the bills S are delivered to the upper space 33 of the stacking unit 32 from the delivery unit 45. On the basis of these signals, the control unit 63 drives the motor 74 to move the regulating member 70 to a position according to the longitudinal dimension (length in the bill delivery direction) of the above denomination. Since there is a time difference between the timing with which the denomination of a bill S are determined in the discrimination unit 30, and the timing with which the bill S is delivered to the upper space 33 from the delivery unit 45, the control unit 63 controls the motor 74 in consideration of this time difference. For this reason, a boundary between the delivery unit 45 and the stacking unit 32 is provided with a timing sensor (illustration thereof is omitted) which detects the delivery of a bill S from the delivery unit 45 to the upper space 33 and outputs the detected result to the control unit 63.

A bill S is delivered to the upper space 33 of the stacking unit 32 from the delivery unit 45, and then advances straight along the top wall 40. Then, the leading edge of the bill is engaged by the stopper 70*b* of the regulating member 70, whereby advancement of the bill S is checked, and the leading edge position of the bill S is regulated. Thereafter, the trailing edge of the bill S is struck and dropped downward by the blades 55 of the impellers 52 and 53. Thereby, bills S are sequentially stacked in the bottom wall 39 while their trailing edges descend along the rear wall 36.

When the leading edge of a bill S is engaged with the stopper 70*b*, the bill S takes a posture of being inclined upward along the top wall 40. Since the impellers 52 and 53 strike and drop the trailing edge of the bill S taking this posture downward by the blades 55, the bill S drops so as to rotate downward about its trailing edge. Accordingly, engagement of the leading edge of a bill S and the stopper 70*b* of the regulating member 70 can be released smoothly. In addition, even when the top wall 40 is made to take a substantially horizontal posture, the same operational effects can be obtained.

As such, even when a plurality of kinds of bills S having longitudinal dimensions different from one another are mixed together and loaded into the charging unit 12, the bills S of all the denominations determined as acceptable can be stacked with their trailing edges being arranged by the rear wall 36. When all the bills S loaded into the charging unit 12 in this way are delivered to either the rejection unit 13 or the stacking unit 32, the control unit 63 causes the separating/feeding unit 20 and the conveying unit 25 to stop, and causes the discrimination results of the bills S stacked in the stacking unit 32 to be displayed on the display unit 64 on the basis of the discrimination results of the discrimination unit 30.

According to the bill processor 11 of the first embodiment described above, after the position of the regulating member 70 in the delivery direction according to the longitudinal dimension (length in the delivery direction) of a bill S, thereby making the leading edge of the bill S delivered from the delivery unit 45 engage the stopper 70*b* of the regulating member 70 to regulate the leading edge position, the trailing edge of the bill S can be struck and dropped by the impellers 52 and 53. Thus, bills S having lengths in the delivery direction different from one another can be aligned and stacked in the stacking unit 32 with their trailing edges arranged.

Also, since the impellers 52 and 53 are made only to rotate in place, it is not necessary to move the impellers 52 and 53 in the bill delivery direction. Accordingly, the structure of the bill processor is simplified, and the impellers 52 and 53 do not make bills S deviate upstream or downstream in the delivery direction. Therefore, bills S can be stacked in the stacking unit 32 favorably.

Moreover, although a succeeding bill S is fed into the upper space 33 of the stacking unit 32 from the delivery unit 45 while the trailing edge of a preceding bill S is struck and dropped by the impellers 52 and 53, stacking of the preceding bill S is not affected at all. Accordingly, even if the conveyance interval of bills S is shortened, aligning and stacking of the bills S can be performed favorably.

Also, since the stopper 70*b* of the regulating member 70 is made to always project downward from the top wall 40, and the regulating member 70 is made movable in the bill delivery direction along the top wall 40, the position of the regulating member 70 can be set freely. Accordingly, it is possible to cope with even a case where bills S have three or more kinds of longitudinal dimensions as well as the case where bills S have two kinds of longitudinal dimensions, and it is thus possible to cope with the versatility of length. It is also possible to simply cope with even a case where the length of bills S in the delivery direction is changed.

Moreover, the position of the regulating member 70 can be set with precision by the position detecting plate 75 and the rotational angle sensor 76.

Also, the waveform forming means 58 composed of the intermediate rollers 46*a* and 46*b*, the outer rollers 47*a* and 47*b*, the outer rollers 48*a* and 48*b*, the conveyance roller 56*a* and the guide 56*b*, and the conveyance roller 57*a* and the guide 57*b* make a bill S into a waveform in a direction orthogonal to its delivery direction, and delivers the bill to the upper space 33 of the stacking unit 32. Accordingly, the rigidity of a bill is increased, and a bill S delivered from the delivery unit 45 can be positively made to advance straight along the top wall 40. As a result, the leading edge of a bill S can be positively made to engage the stopper 70*b* of the regulating member 70.

Moreover, since a bill S delivered from the delivery unit 45 is made to engage the stopper 70*b* at its leading edge in a posture of being inclined downward along the top wall 40, the bill S drops so as to rotate downward about the trailing edge thereof when the trailing edge of the bill S is struck and dropped downward by the blades 55 of the impellers 52 and 53. Accordingly, engagement of the leading edge of a bill S and the stopper 70*b* can be released smoothly.

In addition, in the delivery unit 45, the waveform forming means 58 may be constituted by only nipping by a pair of the intermediate rollers 46*a* and 46*b* and nipping by two pairs of the outer rollers 47*a* and 47*b* and the outer rollers 48*a* and 48*b*. Even in this case, a bill S can be bent in the shape of the letter "V" in the delivery direction thereof. Thus, creases, etc. can be corrected, the rigidity of a bill S can be increased, and straight advancement of a bill when being delivered from the delivery unit 45 can be increased.

Next, a bill processor of a second embodiment of the invention will be described below with reference to FIG. 5.

Figure 5:
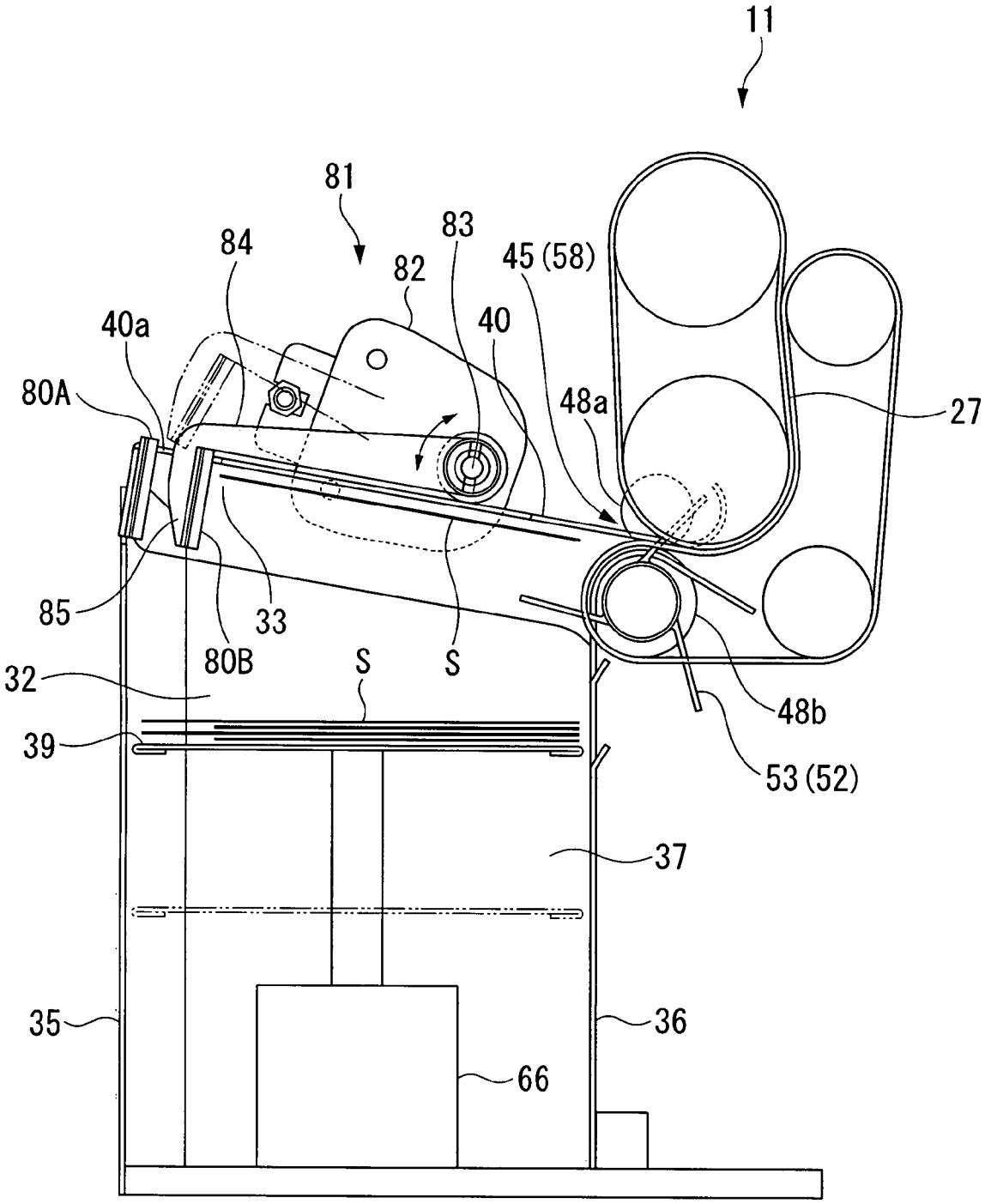
FIG. 5 is a side sectional view schematically showing a bill processor according to a second embodiment of the invention.

FIG. 5 is a side sectional view showing a portion around the delivery unit 45 and the stacking unit 32 in the bill processor 11 of the second embodiment. In this drawing, the same parts as those of the first embodiment are denoted by the same reference numerals, and the description thereof is omitted. Hereinafter, points of difference will now be described. In addition, although the delivery unit 45 including the waveform forming means 58 and impellers 52 and 53 is provided at a terminal end of the conveying path 27 of the bill processor 11 of the second embodiment similarly to the first embodiment, FIG. 5 shows only the outer rollers 48*a* and 48*b* and impellers 52 and 53 for convenience of illustration.

The stacking unit 32 is the same as that of the first embodiment in that it includes the front wall 35, the rear wall 36, the pair of side walls 37, the bottom wall 39, and the top wall 40, and the top wall 40 is installed in such an inclined posture that it rises slightly with respect to the horizontal plane towards the front of the delivery direction. In the second embodiment, the bottom wall 39 is disposed horizontally and is supported so that it can be raised and lowered by an elevating unit 66.

Moreover, the bill processor 11 of the second embodiment includes, as a regulating member which engages the leading edge of a bill S delivered to the upper space 33 of the stacking unit 32 from the delivery unit 45, a first regulating member 80A fixed to an end of the top wall 40 on the side of the front wall 35, and a second regulating member 80B capable of being protruded into or retracted from the upper space 33 through an opening 40*a* formed in an end of the top wall 40 on the side of the front wall 35.

The first regulating member 80A is provided over almost the entire width of the top wall 40 in a direction orthogonal to the bill delivery direction. The second regulating member 80B is disposed at a position where a leading edge of bills S, which are delivered from the delivery unit 45, abuts. The leading edge of bills S abuts against the second regulating member 80B at a substantially middle predetermined width in the lateral direction of bills S. The regulating member 80B is supported so as to be rockable in an up-and-down direction by a regulating member rocking device 81 which is disposed above the top wall 40.

The regulating member rocking device 81 includes a driving unit 82 supported by the processor body above a middle portion of the top wall 40 in the anteroposterior direction of the processor body, a pivot 83 capable of rotating forwardly and reversely by a given angle by way of the driving unit 82, and an arm 84 having a base fixed to the pivot 83 and having a tip extended towards the front side of the processor body. Driving of the driving unit 82 is controlled by a control unit (illustration thereof is omitted). When the pivot 83 is rotated forwardly (clockwise direction in FIG. 5) by way of the driving unit 82, the arm 84 rocks upward about the pivot 83, and when the pivot 83 is made to rotate reversely (in the counterclockwise direction in FIG. 5), the arm 84 rocks downward about the pivot 83. The driving unit 82 can be constituted by, for example, a rotary solenoid. The regulating member rocking device 81, the arm 84, etc. constitute a position changing mechanism for the regulating member.

The tip 85 of the arm 84 is bent substantially perpendicularly downward, and the second regulating member 80B is fixed to the tip 85. As shown by two-dot and dashed lines in FIG. 5, when the pivot 83 is made to rotate forwardly, the tip 85 of the arm 84 and the second regulating member 80B are located above the top wall 40 above the opening 40*a*. When the pivot 83 is made to rotate reversely, the tip 85 of the arm 84 and the second regulating member 80B are protruded into the upper space 33 of the stacking unit 32 through the opening 40*a*, and at the end point of the protrusion, the second regulating member 80B perpendicularly intersects the top wall 40.

According to the bill processor 11 of the second embodiment configured in this way, bills S having two kinds of longitudinal dimensions can be aligned and stacked with their trailing edges in the longitudinal direction arranged. Hereinafter, this operation of the bill processor will be described.

Even in the bill processor 11 of the second embodiment, determination of denomination, authenticity, normal/damaged state, and the like of bills S, and counting of the bills are performed by a discrimination unit (illustration thereof is omitted) while they are conveyed by the delivery unit 45, the bills S determined as acceptable are delivered to the conveying path 27, and the other bills S are delivered to the rejection unit (illustration thereof is omitted) similar to the first embodiment.

The bills S discriminated as acceptable are delivered to the upper space 33 of the stacking unit 32 obliquely upward along the top wall 40 from the delivery unit 45 at the end of the conveying path 27. When a bill S is delivered from the delivery unit 45, the waveform forming means 58 of the delivery unit 45 makes the bill S into a waveform in a direction orthogonal to its delivery direction, thereby forming a waveform. Accordingly, after creases, curls, wrinkles, etc. of the bills S are corrected, they can be delivered to the upper space 33 of the stacking unit 32 and the rigidity of the bills S can be increased to enhance straight advancement. As a result, bills S advance straight along the top wall 40 in the upper space 33 even while they are delivered from the delivery unit 45 or even immediately after they are delivered from the delivery unit 45.

Also, the control unit controls the driving unit 82 according to the denomination of bills S identified in the discrimination unit immediately before the bills S are delivered to the upper space 33 of the stacking unit 32 from the delivery unit 45.

That is, when the discrimination unit determines that a bill S delivered from the delivery unit 45 is a bill S with a long longitudinal dimension, the control unit controls the driving unit 82 so that the pivot 83 may rotate forwardly, thereby rocking the arm 84 upward and retracting the second regulating member 80B above the opening 40*a*. Also, when the discrimination unit determines that a bill S delivered from the delivery unit 45 is a bill S with a short longitudinal dimension, the control unit controls the driving unit 82 so that the pivot 83 may rotate reversely, thereby rocking the arm 84 downward and protruding the second regulating member 80B into the upper space 33 through the opening 40*a*. That is, the position of the regulating member is changed according to the longitudinal dimension (length in the bill delivery direction) of the denomination of bills S.

A bill S is delivered to the upper space 33 of the stacking unit 32 from the delivery unit 45, and advances straight along the top wall 40. In the case of a bill S with a long longitudinal dimension, its leading edge is engaged with the first regulating member 80A whereby advancement of the bill is checked, and the leading edge position of the bill is regulated. In the case of a bill S with a short longitudinal dimension, its leading edge is engaged with the second regulating member 80B whereby advancement of the bill is checked, and the leading edge position of the bill is regulated. Thereafter, as the trailing edge of the bill S is struck and dropped downward by the blades 55 of the impellers 52 and 53, the bill S descends while its trailing edges runs along the rear wall 36, and is sequentially stacked on the bottom wall 39 upward from the bottom.

In a case where the arm 84 has rocked downward when a preceding bill S with a long longitudinal dimension is located along the top wall 40 with its leading edge being engaged with the first regulating member 80A, the tip 85 of the arm 84 and the second regulating member 80B push the leading edge of the preceding bill S downward. Thus, delivery of a succeeding bill S with a short longitudinal dimension will not be affected.

Even in the bill processor 11 of the second embodiment, when the leading edge of a bill S is engaged with the first regulating member 80A or second regulating member 80B, the bill S takes a posture of being inclined upward along the top wall 40. Since the blades 55 of the impellers 52 and 53 strike and drop the trailing edge of the bill S taking this posture downward, the bill S drops so as to rotate downward about its trailing edge. Accordingly, engagement of the leading edge of a bill S and the first regulating member 80A or second regulating member 80B can be released smoothly. In addition, even when the top wall 40 is made to take a substantially horizontal posture, the same operational effects can be obtained.

Accordingly, even when bills S with two kinds of longitudinal dimensions are mixedly conveyed, the bills S of all the denominations determined as acceptable can be aligned and stacked with their trailing edges arranged along the rear wall 36.

According to the bill processor 11 of the second embodiment described above, the position of a regulating member (first regulating member 80A or second regulating member 80B) in the delivery direction is changed by causing the second regulating member 80B to be protruded or retracted according to the longitudinal dimension (length in the delivery direction) of bills S. In a state where a bill S delivered from the delivery unit 45 is made to engage the first regulating member 80A or second regulating member 80B, and thereby the leading edge position of the bill is regulated, the trailing edge of the bill S can be struck and dropped by the blades 55 of the impellers 52 and 53. Accordingly, bills having different lengths in the delivery direction can be aligned and stacked in the stacking unit 32 with their trailing edges arranged.

Even in the bill processor 11 of the second embodiment, the impellers 52 and 53 are made only to rotate in place. Thus, it is not necessary to move the impellers 52 and 53 in the bill delivery direction. Accordingly, the structure of the bill processor is simplified, and the impellers 52 and 53 do not move bills S to the upstream or downstream in the delivery direction. Therefore, bills S can be favorably stacked in the stacking unit 32.

Moreover, although a succeeding bill S is fed into the upper space 33 of the stacking unit 32 from the delivery unit 45 while the trailing edge of a preceding bill S is struck and dropped by the impellers 52 and 53, stacking of the preceding bill S is not affected at all. Accordingly, even if the conveyance interval of bills S is shortened, aligning and stacking of the bills S can be performed favorably.

In the aforementioned example, the case where bills S have two kinds of longitudinal dimensions has been described. However, it is possible to cope with even bills S with three or more kinds of longitudinal dimensions by providing a plurality of arms 84 that are made different in length from one another and are rockable independently, and by providing a regulating member in the tip 85 of each of the arms 84.

Also, a waveform forming part of the delivery unit 45 makes a bill S into a waveform in a direction orthogonal to its delivery direction, and delivers the bill to the upper space 33 of the stacking unit 32 from the delivery unit 45. Accordingly, the rigidity of a bill is increased, and a bill S delivered from the delivery unit 45 can be positively made to advance straight along the top wall 40. As a result, the leading edge of a bill S can be positively made to engage the first regulating member 80A or second regulating member 80B.

Moreover, a bill S delivered from the delivery unit 45 is made to engage the first regulating member 80A or second regulating member 80B at its leading edge in a posture of being inclined upward along the top wall 40. Accordingly, when the blades 55 of the impellers 52 and 53 strike and drop the trailing edge of the bill S taking this posture downward, the bill S drops so as to rotate downward about its trailing edge. As a result, engagement of the leading edge of a bill S and the first regulating member 80A or second regulating member 80B can be released smoothly.

In addition, the invention is not limited to the aforementioned embodiments.

For example, in the bill processor 11 of the first embodiment, the bottom wall 39 of the stacking unit 32 may be supported in an ascending and descending manner.

The invention can also be applied to stacking of bills S in the rejection unit 13. The bill processor of the invention can also be applied to a bill processor which performs various kinds of processing, such as a counting process which counts and returns loose bills S, a receiving and depositing process which counts, receives and deposits loose bills S, and a disbursement process which disburses the bills S received.

What is claimed is:

1. A bill processor comprising:

a stacking unit where bills are stacked;

a delivery unit that substantially horizontally delivers bills one by one to an upper space of the stacking unit;

a striking and dropping unit that strikes and drops the trailing edge of a delivered bill in its delivery direction;

a regulating member that engages the bill delivered to the upper space of the stacking unit at the leading edge of the bill in its delivery direction; and a position changing mechanism that changes the position of the regulating member in the delivery direction according to the length of the bill in the delivery direction, the position changing mechanism having a belt that is wound between a pair of pulleys driven by a motor to support the regulating member, wherein the stacking unit includes: a front wall vertically erected in front of the delivery direction of the bill; a rear wall vertically erected behind the delivery direction of the bill; a top wall that forms an upper edge of the upper space; and a bottom wall which closes a bottom opening of the stacking unit, the top wall is formed in an upwardly inclined posture that ascends towards a front side in the delivery direction of the bill, the top wall has a first end positioned nearer the rear wall than the front wall and has a second end positioned nearer the front wall than the rear wall, and the second end is positioned higher than the first end when viewing the stacking unit from a bottom wall side, and wherein the delivery unit includes two guides which guide bills, each of the guides has an end on a side of the stacking unit, and the end has the same angle of inclination as the top wall.

2. The bill processor according to claim 1, wherein the regulating member is provided in a state of always projecting downward from the top wall and the regulating member is supported so as to be movable in the delivery direction of the bill along the upper wall.

3. The bill processor according to claim 2, wherein the bill processor comprises a position detector that detects the position of the regulating member.

4. The bill processor according to claim 2, wherein the delivery unit includes a waveform forming part that makes the bill into a waveform in a direction orthogonal to the delivery direction.

5. The bill processor according to claim 1, wherein the regulating member is supported from the top wall that forms the upper edge of the upper space of the stacking unit so as to be protrudable into or retractable from the upper space.

6. The bill processor according to claim 5, wherein the position changing mechanism includes an arm that holds the regulating member and is rockable about a pivot, and the arm is rocked about the pivot by a driving mechanism.

7. The bill processor according to claim 6, wherein a plurality of the regulating members are provided.

8. The bill processor according to claim 5, wherein a plurality of the regulating members are provided.

9. The bill processor according to claim 5, wherein the top wall is formed in a substantially horizontal posture or in an upwardly inclined posture that ascends towards the front side in the delivery direction of the bill, and the bill is delivered along the upper wall from the delivery unit.

10. The bill processor according to claim 5, wherein the delivery unit includes a waveform forming part that makes the bill into a waveform in a direction orthogonal to the delivery direction.

11. The bill processor according to claim 1, wherein the delivery unit includes a waveform forming part that makes the bill into a waveform in a direction orthogonal to the delivery direction.

12. The bill processor according to claim 1, wherein the belt is positioned above the top wall, and travels along the top wall.

13. The bill processor according to claim 1, wherein the top wall is formed in an upwardly inclined posture that ascends from a delivery unit side of the stacking unit towards an opposite side to the delivery unit side.

14. A bill processor comprising:

a stacking unit where bills are stacked;

a delivery unit that substantially horizontally delivers bills one by one to an upper space of the stacking unit;

a striking and dropping unit that strikes and drops the trailing edge of a delivered bill in its delivery direction;

a regulating member that engages the bill delivered to the upper space of the stacking unit at the leading edge of the bill in its delivery direction; and a position changing mechanism that changes the position of the regulating member in the delivery direction according to the length of the bill in the delivery direction, wherein the stacking unit includes: a front wall vertically erected in front of the delivery direction of the bill; a rear wall vertically erected behind the delivery direction of the bill; a top wall that forms an upper edge of the upper space; and a bottom wall which closes a bottom opening of the stacking unit, the top wall is formed in an upwardly inclined posture that ascends towards a front side in the delivery direction of the bill, the top wall has a first end positioned nearer the rear wall than the front wall and has a second end positioned nearer the front wall than the rear wall, and the second end is positioned higher than the first end when viewing the stacking unit from a bottom wall side, and the bill is delivered along the upper wall from the delivery unit, and wherein the delivery unit includes two guides which guide bills, each of the guides has an end on a side of the stacking unit, and the end has the same angle of inclination as the top wall.

15. The bill processor according to claim 14, wherein the regulating member is provided in a state of always projecting downward from the top wall, and the regulating member is supported so as to be movable in the delivery direction of the bill along the upper wall.

16. The bill processor according to claim 14, wherein the top wall is formed in an upwardly inclined posture that ascends from a delivery unit side of the stacking unit towards an opposite side to the delivery unit side.

* * * * *